United States Patent [19]

Ingram

[11] Patent Number: 4,838,196

[45] Date of Patent: Jun. 13, 1989

[54] KAYAK SAFETY SPONSONS

[76] Inventor: Robert T. Ingram, SS 1 Site 7 Comp 19, Penetanguishene, Ontario, Canada, L0K 1P0

[21] Appl. No.: 238,130

[22] Filed: Aug. 30, 1988

[51] Int. Cl.[4] ..... B63B 35/71

[52] U.S. Cl. ..... 114/347; 114/123; 114/360

[58] Field of Search ..... 114/347, 360, 123, 68, 114/69; 441/40, 41, 66

[56] References Cited

U.S. PATENT DOCUMENTS

| | | | |
|---|---|---|---|
| 883,588 | 3/1908 | Thatcher | 114/69 |
| 1,038,928 | 9/1912 | Menzel | 114/360 |
| 1,181,636 | 5/1916 | Bouget | 114/68 |
| 1,622,508 | 3/1927 | Harper | 114/360 |
| 2,327,794 | 8/1943 | Hurt | 441/66 |
| 2,600,757 | 6/1952 | Grimston | 114/345 |
| 3,339,218 | 9/1967 | Stamberger | 441/40 |

FOREIGN PATENT DOCUMENTS

| | | | |
|---|---|---|---|
| 327803 | 4/1930 | United Kingdom | 114/354 |

*Primary Examiner*—Sherman D. Basinger
*Assistant Examiner*—Thomas J. Brahan

[57] ABSTRACT

Kayak safety sponsons having two parallel inflatable tubes along the waterline on each side of the kayak adjacent the cockpit. These tubes join together below the waterline by means of material such as straps and above the waterline at both ends by a fastener such as a strap with a quick-release buckle, at each end of the cockpit. They can be attached and inflated by the kayaker seated in the cockpit while using a paddle. Deflated, the sponsons are flat and tightly drawn against the hull by the two fasteners for minimal water resistance. Inflated, the sponsons taper toward both ends for minimal water resistance, increasing maximum waterline beam of the kayak adjacent to the cockpit area but not affecting foreward and aft lines of the craft, permitting normal handling due to minimal change in underwaterlines and minimal increase in water resistance.

2 Claims, 1 Drawing Sheet

KAYAK SAFETY SPONSONS

BACKGROUND OF THE INVENTION

1. Field on the Invention

The invention relates to safety sponsons for narrow kayaks, in particular sponsons which are quickly attached to the hull and inflated by the kayaker while seated in the cockpit and able to use a paddle; the kayak paddled normally due to minimal change in the lines of the hull and minimal increase in water resistance.

2. Prior Art

Kayakers have experimented with various inflatable devices which extend from the sides of the craft to provide additional stability. Paddle floats and air mattresses are examples. However these devices can capsize a craft in waves by digging in as the kayak slides down a large wave. As well, when employed, the kayak cannot be paddled normally, whether or not they are inflated. A course away from a hazard such as a reef cannot be held. Paddlers of narrow craft normally use their paddles to brace into large waves for extra stability when needed. Sick, injured or less able paddlers, unable to use effective paddle braces, require additional stability in heavy seas. But the kayaks must be manouverable. Narrow kayaks are not as suitable for activities such as fishing, skin diving or sailing due to tippiness, compared to wider boats. Following capsize the narrow kayak is difficult to re-enter, particularly in heavy seas. If totally filled with water or with inadequate floatation, it may be impossible to pump out, in heavy seas.

It is desireable to have a means to create additional stability through extra buoyancy quickly, without the penalty of handling problems. It is necessary for the device to lie flat, tightly against the hull, allowing the craft to be paddled normally, in anticipation of the need for greater stability, particularly for inexperienced paddlers developing their confidence. It is also necessary that the sponsons can be attached quickly using few fasteners and inflated while seated in the cockpit and able to use a paddle, if required for stability. Following capsize the device must be capable of deployment from the water. It is desireable as well that the device can be quickly deflated, detached and folded for storage in a small space within the cockpit area when the speed and performance of a narrow kayak is to be enjoyed, additional stability not needed.

SUMMARY OF THE INVENTION

The present invention reduces some of the problems of the prior art by providing safety sponsons which quickly add stability when required without creating handling problems. The sponsons may be attached or removed, inflated or deflated, quickly, from the cockpit or the water. The sponsons use only two fasteners, each adjacent a cockpit end and are inflated by means of a long tube reaching to the paddler's mouth which do not prevent use of a paddle. The fasteners bind the sponsons tightly to the hull, fore and aft, whether inflated or not, for minimal water resistance which may be further decreased through use of a single sheet of material connecting the sponsons together along their full length, even enclosing them for abrasion protection, below the waterline, instead of straps or cord.

The safety sponsons, according to the invention consist of two parallel inflatable tubes, each lying against the hull of the kayak along the waterline on one side of the cockpit and characterized by two fasteners joining the ends of the tubes above the waterline such as straps with quick-release Nifco, a Trademark, buckles which are tightened adjacent each cockpit end. The ends of the tubes are joined below the waterline by either straps or a single sheet of material attached the full length of both tubes. The deflated tubes are flat and lie tightly against the hull surface when the two fasteners are tightened, for minimal water resistance. Furthermore the tubes taper at the ends for minimal water resistance. A tube may be inflated by the kayaker while seated and using a paddle by means of a long, smaller diameter tube with an air valve which reaches and fits inside the kayaker's mouth. The sponsons quickly attach, inflate, deflate, detach and fold up while the kayaker remains seated and able to use a paddle. They store in a small space within the cockpit area of the kayak. The inflated sponsons increase the maximum waterline beam adjacent the cockpit area but blend with and do not alter the lines of the hull fore and aft. Therefore the turning and tracking abilities of the kayak are not adversely affected.

The invention, as exemplified by a preferred embodiment, is described with reference to the drawings.

DETAILED DISCLOSURE

Figure 1:
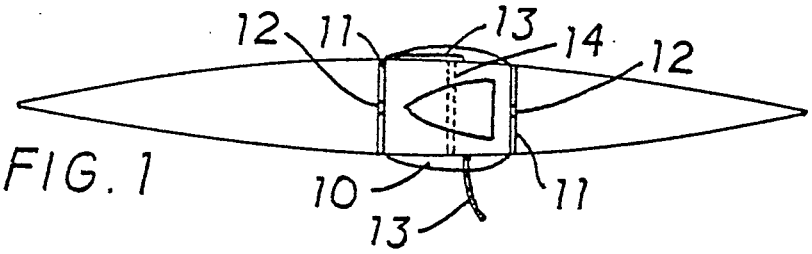
FIG. 1 is a simplified top view of the kayak safety sponsons attached to a kayak adjacent the cockpit and inflated.
Figure 2:
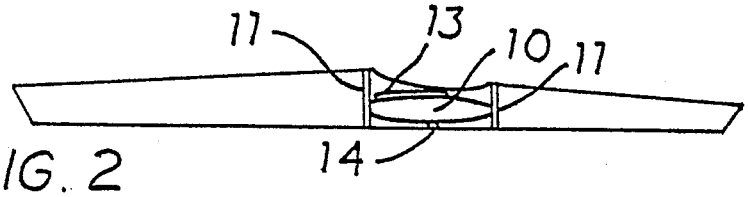
FIG. 2 is a simplified side elevation of the sponsons attached to the kayak and inflated.
Figure 3:
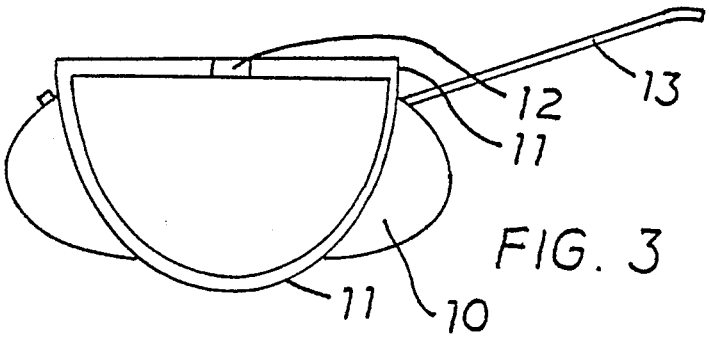
FIG. 3 is a simplified transverse section showing the inflated sponsons attached to the kayak.
Figure 4:
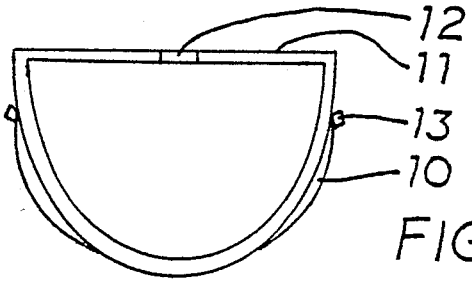
FIG. 4 is a simplified transverse section showing the sponsons attached to the kayak but deflated and lying flat, tightly against the hull surface.

FIGS. 1 through 4

Referring to FIGS. 1 through 4 kayak safety sponsons 10 according to the invention are attached to the kayak adjacent the cockpit by straps 11 which encircle the kayak and buckles 12. Sponsons 10 taper at both ends for minimal water resistance. Inflation tubes 13 allow inflation of the sponsons by the kayaker who can take the air valve at the end of the tube in his mouth to inflate the sponsons while continuing to use the paddle to handle the kayak in seas. The inflation tubes 13 lie in the groove between the tube and the hull of the kayak before and after inflation. The strap 14 connects the midpoints of the sponsons below the waterline to transmit buoyancy force to the hull. Underwater portions of straps 11 and strap 14 may be substituted for by a single sheet of strong thin and flexible material connecting the entire lengths of the sponsons 10 together, below the waterline and possibly enclosing the sponsons for abrasion protection. Deflated sponsons 10 lie flat against the hull surface drawn tightly by straps 11 and buckles 12 for minimal water resistance and effect upon the paddling of the kayak.

Sponsons can be attached, detached, inflated and deflated by the kayaker seated in the kayak, while still being able to use the paddle as required for bracing or handling of the kayak in seas during these operations. All these operations can be performed from the water following capsize and righting of the kayak. Sponsons are attached to the kayak adjacent the cockpit area only, for control of the above operations by the kayaker seated in the cockpit and to not interfere with such handling characteristics of the craft as tracking and turning. The lines of the kayak change, upon inflation of the sponsons, with respect to an increase of maximum waterline beam; the taper of the sponsons and the tightness to the hull allowing conversion of the crafts waterline beam with minimum disruption of the kayak's handling characteristics due to increased water resistance and disruption of the water flow over the hull surface.

OPERATION

Referring to FIGS. 1 through 4 it can be seen that the safety sponsons 10 are attached only to the hull surface immediately adjacent the cockpit, within the reach of the kayaker, seated in the cockpit. The deflated sponsons attached to the kayak lie flat against the hull, drawn tightly against the hull surface by the two straps and buckles, 11 and 12 respectively, in order to create minimal water resistance. The inflated sponsons, tapering at both ends, create minimal water resistance and effects on normal handling of the kayak, as the maximum waterline beam is increased while foreward and after underwater sections of the hull remain unchanged. The kayaker may continue to paddle the kayak normally at all times while using the kayak safety sponsons.

The deflated sponsons are normally folded and stored in a small space within the cockpit area of the kayak. The kayaker may attach the sponsons to the hull by reaching foreward with both hands beneath the hull of the kayak to grab the foreward fastener, (strap 11, buckle 12), and draw one sponson underneath the hull to the opposite side. The foreward fastener is connected and tightened. With each sponson lying along the waterline on opposite sides of the kayak, the kayaker reaches back to grab and connect the aft fastener (strap 11, buckle 12) which is tightened along the deck aft of the cockpit, ensuring that the sponsons lie flat, their full length along both sides of the hull. The kayaker can conduct the same operation from the water normally connecting the foreward fastener first as most kayaks are narrower in circumference forward of the cockpit than aft, in order to secure the device to the kayak most quickly and easily in an emergency.

The sponsons are inflated by mouth using the long inflation tubes and air valves 13 in the kayaker's mouth while the kayaker may still use the paddle as required. The inflation tubes are stored, when not in use, along the grooves created between the sponsons and the hull nearest the gunwales. Sponsons are deflated by opening the air valve and pressing air out of the sponsons before disconnecting the two fasteners at either end of the cockpit, pulling the device out of the water, folding and storing it inside the kayak.

I claim:

1. An adjustable buoyancy system for attachment to a kayak having a cockpit comprising:

a pair of tapered buoyancy tubes extending along the waterline, one on each side of said kayak, said buoyancy tubes having a length approximately the length of said cockpit of said kayak, a first connecting means extending between said pair of buoyancy tubes adapted to extend under said kayak, a second connecting means extending between said buoyancy tubes and adapted to extend over said kayak, said second connecting means including attachment means to facilitate attachment and removal of said buoyancy tubes from said kayak, and a pair of inflation tubes, one attached to each of said buoyancy tubes, said inflation tubes having a length sufficient to reach the user seated in said cockpit to allow the user to inflate said buoyancy tubes from a non-inflated condition with said buoyancy tubes lying flat against said kayak, to an inflated condition to stabilize said kayak.

2. An adjustable buoyancy system for a kayak as recited in claim 1, wherein said first connecting means comprises a continuous sheet of material.

* * * * *